US006276545B1

(12) United States Patent
Ferrari

(10) Patent No.: US 6,276,545 B1
(45) Date of Patent: Aug. 21, 2001

(54) LEVER ACTUATED UNIVERSAL STOPPER FOR OPENED BOTTLES

(75) Inventor: Ruggero Ferrari, Parma (IT)

(73) Assignee: Marisa Marchignoli, Parma (IT)

( * ) Notice: Subject to any disclaimer, the term of this patent is extended or adjusted under 35 U.S.C. 154(b) by 0 days.

(21) Appl. No.: 09/509,604

(22) PCT Filed: Sep. 23, 1998

(86) PCT No.: PCT/IT98/00254

§ 371 Date: Mar. 29, 2000

§ 102(e) Date: Mar. 29, 2000

(87) PCT Pub. No.: WO99/18003

PCT Pub. Date: Apr. 15, 1999

(30) Foreign Application Priority Data

Oct. 3, 1997 (IT) ..... PR97A0053

(51) Int. Cl.[7] ..... B65D 45/16

(52) U.S. Cl. ..... 215/293; 215/319; 215/364; 215/274; 215/284; 220/233; 220/287; 220/285; 285/318

(58) Field of Search ..... 215/355, 364, 215/319, 359, 293, 284, 294, 274, 296; 220/254, 287, 285, 284, 233, 234; 285/318, 312, 346, 358

(56) References Cited

U.S. PATENT DOCUMENTS 634,240 * 10/1899 Hoyt .
1,469,487 * 10/1923 Schedler .
1,966,611 * 7/1934 Cobel .
2,170,531 * 8/1939 Kahn ..... 215/280 X
3,738,688 * 6/1973 Racine ..... 285/346 X
3,779,587 * 12/1973 Racine ..... 285/346 X
4,691,836 * 9/1987 Wassilieff ..... 215/294 X
4,750,762 * 6/1988 Corzine ..... 285/318 X
5,056,676 * 10/1991 Allen et al. ..... 215/280 X
5,727,821 * 3/1998 Miller ..... 285/318
5,957,313 * 9/1999 Bouan ..... 215/280 X

FOREIGN PATENT DOCUMENTS 845 303 7/1952 (DE) .
0 736 4761 10/1996 (EP) .
809 306 3/1937 (FR) .

* cited by examiner

*Primary Examiner*—Allan N. Shoap
*Assistant Examiner*—Robin A. Hylton
(74) *Attorney, Agent, or Firm*—Darby & Darby

(57) ABSTRACT

A stopper for opened bottles having an external body (1) provided with an upper opening (4) designed to allow rotation of a lever (8) having an eccentricity (9). Operation of the lever allows, through an intervening arrangement of a cylindrical helical spring (22), lowering of an internal body (16) against a toroidal spring (15) causing radial deformation of the toroidal spring to allow gripping of the neck of the bottle underneath a shoulder on the bottle neck.

12 Claims, 2 Drawing Sheets

Fig. 3
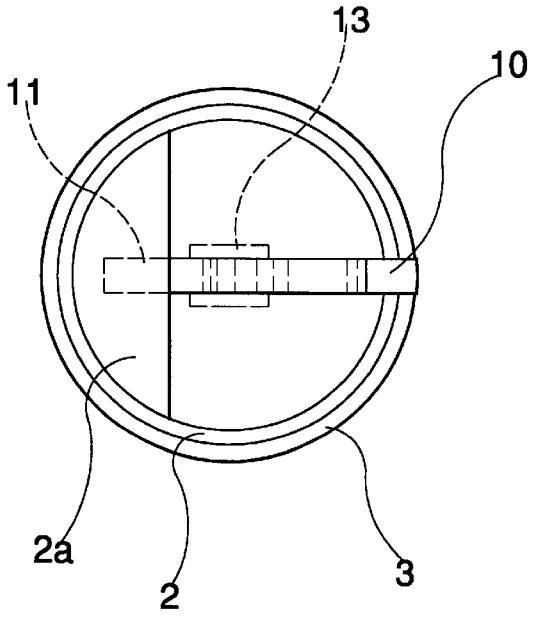
Fig. 4
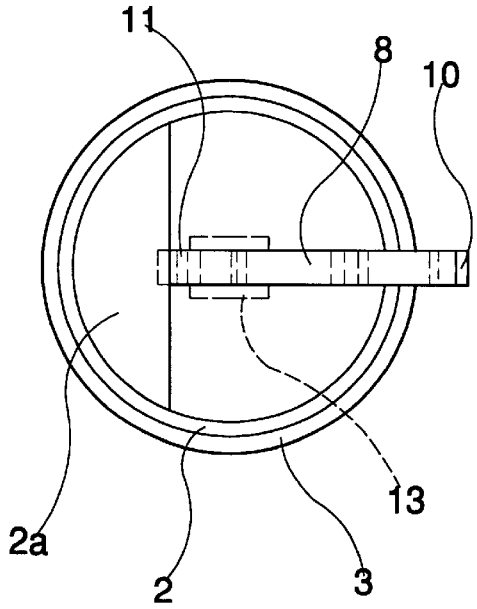
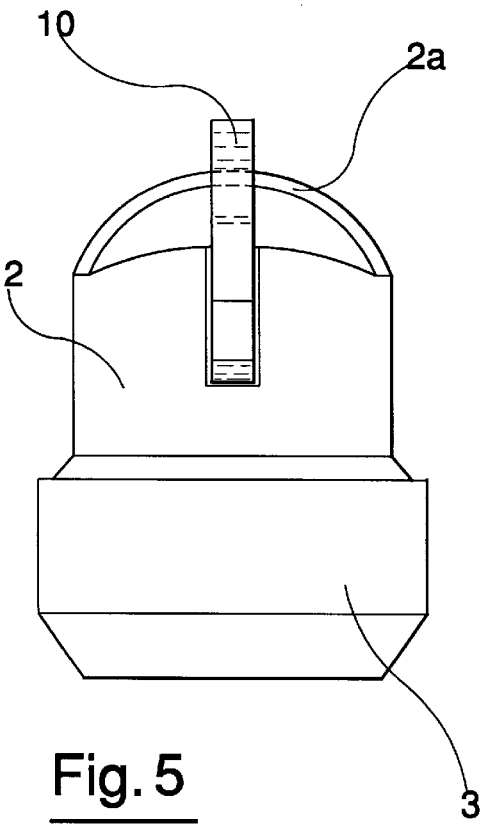
Fig. 5
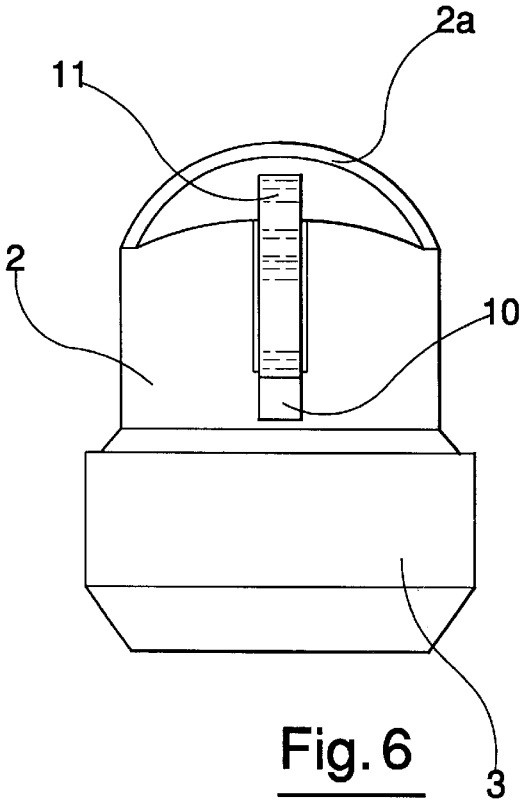
Fig. 6

LEVER ACTUATED UNIVERSAL STOPPER FOR OPENED BOTTLES

FIELD OF THE INVENTION

1. Background of the Invention

The present invention relates to a univeral stopper for opened bottles. In order to ensure the closure of opened bottles, various types of stoppers have been devised, all of which can be substantially classified in two main groups: stoppers which perform closure of the bottle by causing expansion of one of their components inside the neck of the bottle itself and stoppers which embrace the external surface of the neck of the bottle, making use of its shoulder to ensure a good gripping action.

All these stoppers are provided with means designed to ensure removal of the stopper itself, if possible using a small amount of physical force.

A drawback present in many of the stoppers which are currently commercially available is that they may be difficult to adapt to the various types of necks which may arise.

2. Brief Description of the Invention

The object of the present invention is that of providing a stopper which is extremely versatile and easy to use.

These and other objects are all achieved by the universal stopper for opened bottles according to the present invention, characterized in that it comprises:

- an external body which is substantially cylindrical and internally hollow and provided with an upper opening designed to allow rotation of a lever; the bottom part of said external body being provided with a circular opening designed to allow the neck of a bottle to pass through and being provided internally with a circumferential flaring designed to seat a toroidal spring; said spring being able to perform external circumferential locking of the neck of the bottle underneath the associated shoulder;
- an internal body, which is substantially cylindrical and designed to slide longitudinally along the internal surface of the said external body, said internal body having its bottom edge in contact with the toroidal spring;
- a cylindrical helical compression spring which is positioned between the top part of the internal body and a disk arranged in turn between the said spring and the lever; said spring being designed to convert the rotational movement of this lever into the radial deformation of the toroidal spring in order to compensate for the differences existing both in the diameters of the necks of the various bottles and in the heights of the various shoulders.

BRIEF DESCRIPTION OF THE DRAWINGS

These and other characteristic features will emerge more clearly from the following description of a preferred embodiment illustrated, purely by way of a non-limiting example, in the accompanying illustrative plate in which:

FIG. 3 shows a top view of the stopper when the latter is in the open position;

FIG. 4 shows a top view of the stopper when the latter is in a closed position;

FIG. 5 shows a side view of the stopper when the latter is in the open position; and FIG. 6 shows a side view of the stopper when the latter is in a closed position.

Figure 1:
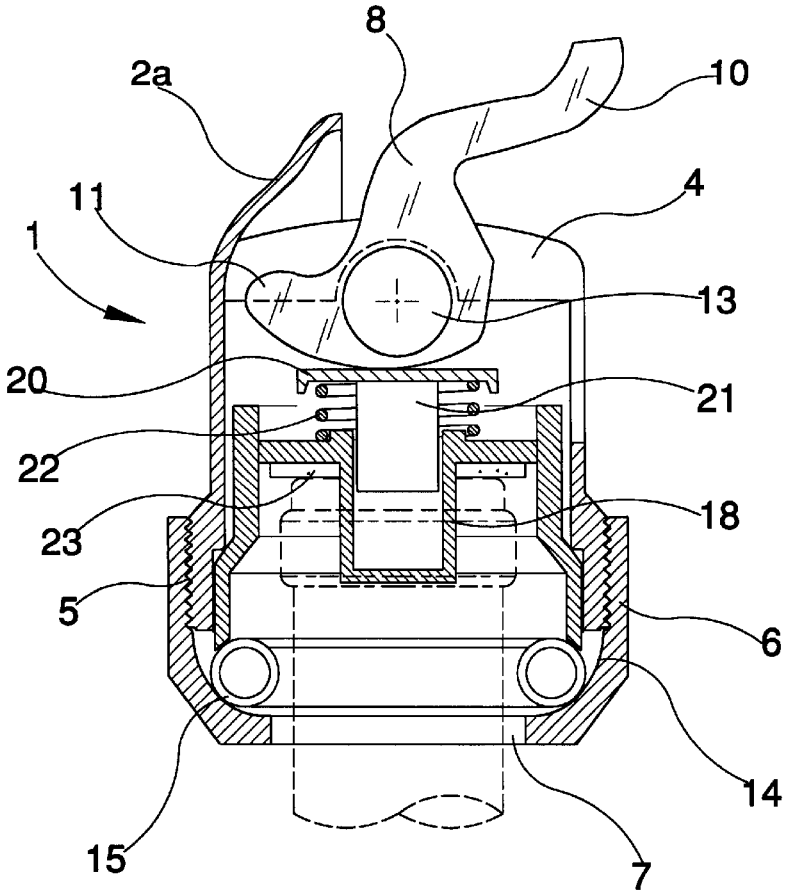
FIG. 1 shows a view sectioned diametrically along the vertical axis of the stopper, when the latter is in the open position.

An external body 1, which is substantially cylindrical and internally hollow, is composed of two portions 2 and 3, respectively an upper portion and a lower portion.

The upper portion 2 has an upper opening 4 which is substantially configured with a slit centred and oriented parallel with respect to the central vertical axis of the external body 1. (see FIGS. 3–6)

Said upper portion has a crest 2*a* centred with the longitudinal axis of the said upper opening; said crest is closed on three sides connected to the external surface of the external body 1, while on the fourth side, facing the upper opening 4, it also has a slit with the same width as that forming the said upper opening. The crest 29 provides a support for the thumb during operation of the lever.

The bottom edge of the said portion has an external threading 5.

The top edge of the lower portion 3 is provided with an internal threading 6 having a pitch corresponding to that of the said external threading of the upper portion 2; the bottom side of the lower portion 3 is provided with a circular opening 7, the diameter of which is greater than the external diameter of the shoulder on the bottles.

The slit forming the upper opening 4 is intended to allow the partial rotation of a lever 8 provided with a central body having an eccentricity 9, with an operating arm 10 and an opening arm 11 extending from the said central body.

Positioning of the lever 8 inside the upper opening 4 is performed by two identical semi-circular recesses 12, each of which is formed in the thickness of each of the facing sides of the said upper opening: said recesses have a diameter and depth corresponding to the diameter and to the thickness of two circular projections 13 which are symmetrically located on the two opposite sides of the lever 8; the two said projections, together, form the pivot for rotation of the said lever.

Considering again the lower portion 3, the surface of its bottom edge is provided with a circumferential flaring 14.

Said flaring acts as a guideway for a toroidal spring 15 having, in the rest condition, an internal diameter which is greater than that of the shoulder on the bottles.

The external surface of an internal body 16 which has a substantially cylindrical shape has an external diameter which is slightly less than the internal diameter of the upper portion 2.

The said internal body has at the top a circular diaphragm 17 provided in its centre with a blind recess 18; underneath said diaphragm the internal body 16 is completely hollow and its bottom edge makes contact with the toroidal spring 15.

Said bottom edge has a chamfering 19 directed towards the inside.

The lever 8 acts on a disk 20, the bottom side of which has integrally attached to its centre a piston 21 having an external diameter which is slightly smaller than the internal diameter of the blind recess 18.

A cylindrical helical compression spring 22 is positioned, circumferentially around the piston 21, between the bottom side of said disk and the top side of the circular diaphragm 17.

A seal 23 is situated against the bottom side of the circular diaphragm 17, said seal being intended to provide a sealing action against the top edge of the bottle.

In a variation of embodiment, not shown in the Figures, a small spring is inserted between the seal 23 and the circular diaphragm 17.

The operating principle of the universal stopper for opened bottles according to the present invention will now be described in connection with the reference numbers shown in the Figures:

Firstly it is checked that the operating arm 10 is positioned vertically inside the slit-shaped upper opening 4, as illustrated in FIG. 1.

Then the external body 1 is gripped and is positioned around the top part of the neck of the bottle, inserting said neck into the circular opening 7 with which said external body is provided at the bottom.

In so doing the neck of the bottle penetrates inside the circumferential cavity of the internal body 16.

The external body 1 is lowered until the top edge of the neck of the bottle comes into contact against the seal 23; at the same time, the blind recess 18 penetrates inside the neck itself.

Figure 2:
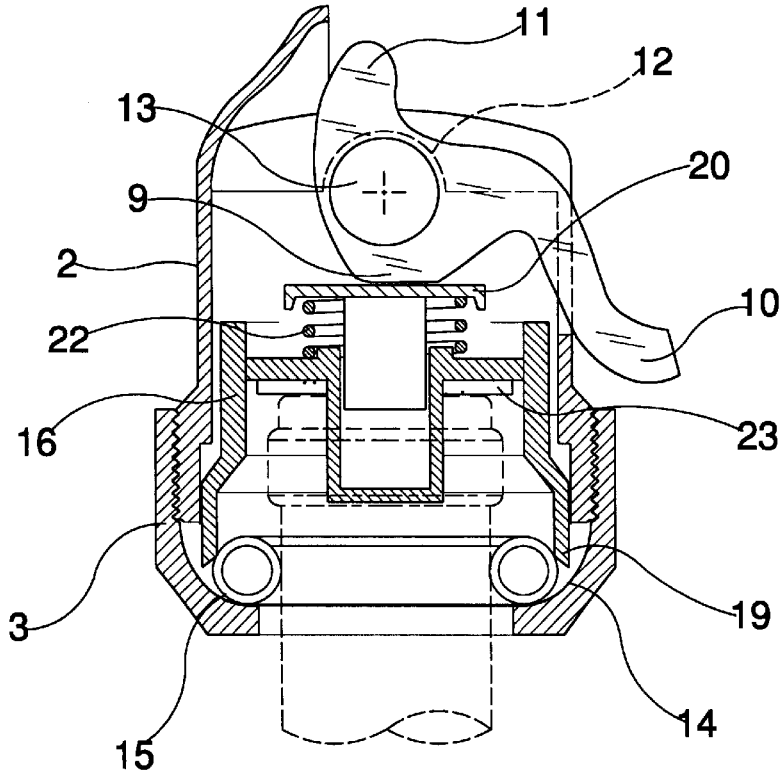
FIG. 2 shows a view, sectioned as above, with the stopper in the closed position.

Once the bottle has been positioned in the manner described above, the lever 8 is rotated, lowering the operating arm 10 retained between the index finger and middle finger of the same hand which hitherto has gripped the external body 1; the said lever, at this point, is positioned as shown in FIG. 2.

Said rotation of the lever 8 is performed about the two circular projections 13 which, together, form the pivot therefor inside the two corresponding semi-circular recesses 12. During the course of said rotation, the eccentricity 9 of the curved profile of the said lever causes downwards displacement of the disk 20 which is kept pressed against the said profile by the cylindrical helical spring 22 resting on top of the circular diaphragm 17 of the internal body 16.

Said spring, always pressing the lever 8 upwards, ensures the stable positioning of the circular projections 13 inside the respective semicircular recesses 12 and, consequently, the stable positioning of the centre of rotation of the said lever. The cylindrical helical spring 22 cannot be displaced from its working position since it is circumferentially positioned around the piston 21 which is in turn guided by the internal profile of the blind recess 18.

Lowering of the disk 20, by means of the intervening arrangement of the spring 22, causes lowering of the internal body 16; said lowering movement causes the bottom edge thereof to press with force against the external surface of the toroidal spring 15, facilitating the gripping action thereof on account of the internal chamfering 19 with which it is provided. The toroidal spring 15, which is compressed from above, is lowered, sliding along the circumferential flaring 14 and is radially deformed, thereby clasping the neck of the bottle and thus ensuring sealing thereof.

In order to ensure improved positioning stability of the stopper and, ultimately, a more effective sealing action thereof, it is important that gripping of the said toroidal spring on the neck of the bottle should take place underneath the bottom edge of the shoulder, irrespective of the diameter of the necks and the height of the shoulders; for this purpose the presence of the cylindrical helical spring 22 is decisive because its resilient action allows compensation of the differences which occur between the various types of bottles.

When it is required to remove the stopper, the external body 1 is gripped again and, using a finger of the same hand, the lever 8 is rotated in an opposite manner to that which was performed for the stopper closing action, moving back its opening arm 11 projecting from the vertical profile of the crest 2*a*.

In the above description specific reference was made to the fact that the connection between the upper portion 2 and the lower portion 3 of the external body 1 is performed by means of a threading, but it is obvious that this connection could be realized in other ways and using other means such as, for example, force-fitting joints.

What is claimed is:

1. Universal stopper for opened bottles comprising:

an internally hollow external body having an upper opening;

a lever pivotally mounted to said body and movable in said upper opening;

an opening in the bottom part of said external body to allow the neck of a bottle to pass through, said body having an internally circumferential flared wall and a toroidal spring seated opposing said wall, said toroidal spring to perform external circumferential locking to the neck of the bottle, beneath a shoulder on the bottle neck;

an internal body within said external body to slide longitudinally along the internal surface of said external body, said internal body having its bottom edge in contact with said toroidal spring; and a helical compression spring positioned between a top part of said internal body and a disk arranged between said helical spring and said lever, said helical compression spring being engaged by said disk and converting the rotational movement of said lever into radial deformation of said toroidal spring as said lever is rotated to compensate for differences existing both in the diameters of the necks of the various bottles and in the heights of the various shoulders.

2. Universal stopper according to claim 1 wherein said external body comprises an upper portion and a lower portion connected by an external threading on the bottom edge of said upper portion and mating internal thread on the top edge of said lower portion.

3. Universal stopper according to claim 2 wherein the top part of said upper portion is substantially dome shaped and has an opening formed with a centered slit having a width slightly greater than the thickness of said lever to allow rotation of said lever.

4. Universal stopper according to claim 3 wherein said upper portion has a crest centered with respect to the longitudinal axis of the slit forming the upper opening, said slit continuing into said crest on the side thereof facing said upper opening, the remaining sides of the crest being closed, said crest providing a support for the thumb during operation of said lever.

5. Universal stopper according to claim 1 wherein said lever is pivotally hinged on the upper portion of the external body by two projections symmetrically located on the opposite sides of said lever, said projections corresponding, in diameter and thickness, to the diameter and the depth of two semi-circular recesses each formed in the thickness of each of the facing sides of the upper opening, the two said projections together forming the pivot for rotation of said lever.

6. Universal stopper according to claim 1 wherein said lever has two substantially radial arms comprising an operating arm and an opening arm, both said arms being designed to be operated by the fingers.

7. Universal stopper according to claim 1 wherein the bottom internal edge of said internal body has a chamfering to accommodate compression of said toroidal spring against the neck of the bottle sliding along a part of said toroidal spring.

8. Universal stopper according to claim 1 wherein said cylindrical helical spring rests against a circular diaphragm positioned below the top edge of said internal body, the internal body below the said diaphragm being hollow and defining a cavity to seat the neck of a bottle.

9. Universal stopper according to claim 8 wherein said circular diaphragm has in its center a blind recess forming a guide for the vertical sliding of a piston which is integrally attached to the bottom side of a disk, said cylindrical helical spring being around said piston.

10. Universal stopper according to claim 1 wherein the upper portion and the lower portion of said external body comprise force-fitting joints joining them together.

11. Universal stopper according to claim 8 further comprising a seal positioned underneath the circular diaphragm and a spring between the seal and the circular diaphragm.

12. Universal stopper according to claim 9 further comprising a seal positioned underneath the circular diaphragm and a spring between the seal and the circular diaphragm.

* * * * *